US008771435B2

(12) United States Patent
Graffius

(10) Patent No.: US 8,771,435 B2
(45) Date of Patent: Jul. 8, 2014

(54) POOL CLEANING DEVICE

(76) Inventor: John M. Graffius, Glendora, CA (US)

( * ) Notice: Subject to any disclaimer, the term of this patent is extended or adjusted under 35 U.S.C. 154(b) by 251 days.

(21) Appl. No.: 13/014,433

(22) Filed: Jan. 26, 2011

(65) Prior Publication Data

US 2012/0186612 A1 Jul. 26, 2012

(51) Int. Cl.
*B08B 9/00* (2006.01)
*E04H 4/16* (2006.01)
*B08B 3/02* (2006.01)

(52) U.S. Cl.
CPC ..... *B08B 3/02* (2013.01); *E04H 4/1618* (2013.01)
USPC ..... 134/166 R

(58) Field of Classification Search
CPC ..... E04H 4/16; E04H 4/1609
USPC ..... 15/1.7; 134/166 R, 166 C, 167 R, 167 C
See application file for complete search history.

(56) References Cited

U.S. PATENT DOCUMENTS 1,516,359 A * 11/1924 Tideman ..... 137/577.5
3,393,873 A * 7/1968 Larson ..... 239/533.15
3,782,641 A * 1/1974 Springer ..... 239/598
4,247,216 A * 1/1981 Pansini ..... 403/109.3
5,133,503 A * 7/1992 Giordano et al. ..... 239/532
2004/0070196 A1* 4/2004 Robertson ..... 285/5
2005/0279683 A1* 12/2005 Erlich et al. ..... 210/169
2006/0085929 A1* 4/2006 Deklinski ..... 15/1.7
2011/0047726 A1* 3/2011 James ..... 15/1.7

* cited by examiner

*Primary Examiner* — David Cormier
(74) *Attorney, Agent, or Firm* — Heidi L. Eisenhut; Loza & Loza LLP

(57) ABSTRACT

Embodiments of the invention are directed to pool cleaning devices adapted to simultaneously couple to a telescopic pole and a nozzle of a hose at separate openings, respectively. In one embodiment, the pool cleaning device comprises a primary component having a tubular configuration and terminating in an angled configuration therewith. A secondary component is in fluid communication with a medial portion of the primary component and angled at between 15° and 30° relative to the primary component. The secondary component is coupled to a ball valve for restricting or allowing the flow of water through the device. When a telescopic pole and a hose are simultaneously coupled to the separate openings on the primary component and the secondary component, respectively, the device may be use to create high pressure flow to clean submerged surfaces or water surface debris with little effort exerted by the user.

18 Claims, 3 Drawing Sheets

POOL CLEANING DEVICE

FIELD OF INVENTION

Pool cleaning devices.

BACKGROUND OF INVENTION

A swimming pool is a man-made opening (generally below ground level) or container (generally above ground level) filled with water intended for swimming or water-based recreation. Chemical disinfectants such as chlorine, bromine or mineral sanitizers, and additional filters are often used in swimming pools to control the growth and spread of bacteria, viruses, algae and insect larvae. However, such chemicals do not completely prevent the growth and spread of these environmental constituents. Moreover, such chemicals cannot control the accumulation of leaves and other natural debris, which collects in pools on a regular basis (assuming vegetation in or around the pool). As such, pool cleaning and/or maintenance equipment is often used on a regular basis to maintenance swimming pools.

Many swimming pool owners use automatic cleaners, however, basic pool cleaning equipment is often still required. For example, a telescopic pole, a skim net, pool brushes and a test kit are considered a "must" for any pool owner. Telescopic poles usually extend and then twist lock in place. Most telescopic poles have two holes at the distal end which are designed to accept a wide range of accessories.

One of the most overlooked maintenance steps of pool care is brushing. Swimming pools should be brushed at least once per week. Brushing removes algae and other films and dirt on pool walls and pool floors that generally cannot be removed by vacuuming or by chemical treatment. A weekly brushing may avoid "slimy" walls and slick film that is common with pools and spas. However, brushing is very labor intensive and time consuming.

Consequently, a pool cleaning device which alleviates the disadvantages of prior art devices is needed.

SUMMARY OF INVENTION

A pool cleaning device, comprising: (a) a primary component comprising a proximal portion, a medial portion and a distal portion, the distal portion angled relative to the proximal and medial portions, the primary component allowing a fluid to flow therethrough; (b) a secondary component in fluid communication with the primary component, the secondary component comprised of an angled tubular member wherein the secondary component is angled between 15° and 30° relative to the primary component; and (c) a ball valve shut-off component in fluid communication with the angled tubular member, a proximal end of the ball shut-off valve component terminating in a hose connection component is herein disclosed.

The distal portion of the primary component may terminate in a nozzle. The proximal portion of the primary component may have a diameter less than a diameter of the medial portion of the primary component. The proximal portion of the tubular member may have at least two apertures distanced 180° from one another. At least two apertures are adapted to receive buttons from a push-button locking mechanism positioned within the proximal portion of the tubular member. The primary component may be adapted to couple to a telescopic pole. The hose connection member may be adapted to couple to a hose nozzle. The ball valve shut-off component may include an ON/OFF knob on an outer surface thereof.

DETAILED DESCRIPTION

The following detailed description is of the best currently contemplated modes of carrying out the invention. The description is not to be taken in a limiting sense, but is made merely for the purpose of illustrating the general principles of the invention.

Embodiments of the invention are directed to pool cleaning devices adapted to simultaneously couple to a telescopic pole and a nozzle of a hose at separate openings, respectively. In one embodiment, the pool cleaning device comprises a primary component having a tubular configuration and terminating in an angled configuration therewith. A secondary component is in fluid communication with a medial portion of the primary component and angled at between 15° and 30° relative to the primary component. The secondary component is coupled to a ball valve for restricting or allowing the flow of water through the device. When a telescopic pole and a hose are simultaneously coupled to the separate openings on the primary component and the secondary component, respectively, the device may be use to create high pressure flow to clean submerged surfaces or water surface debris with little effort exerted by the user.

Figure 1:
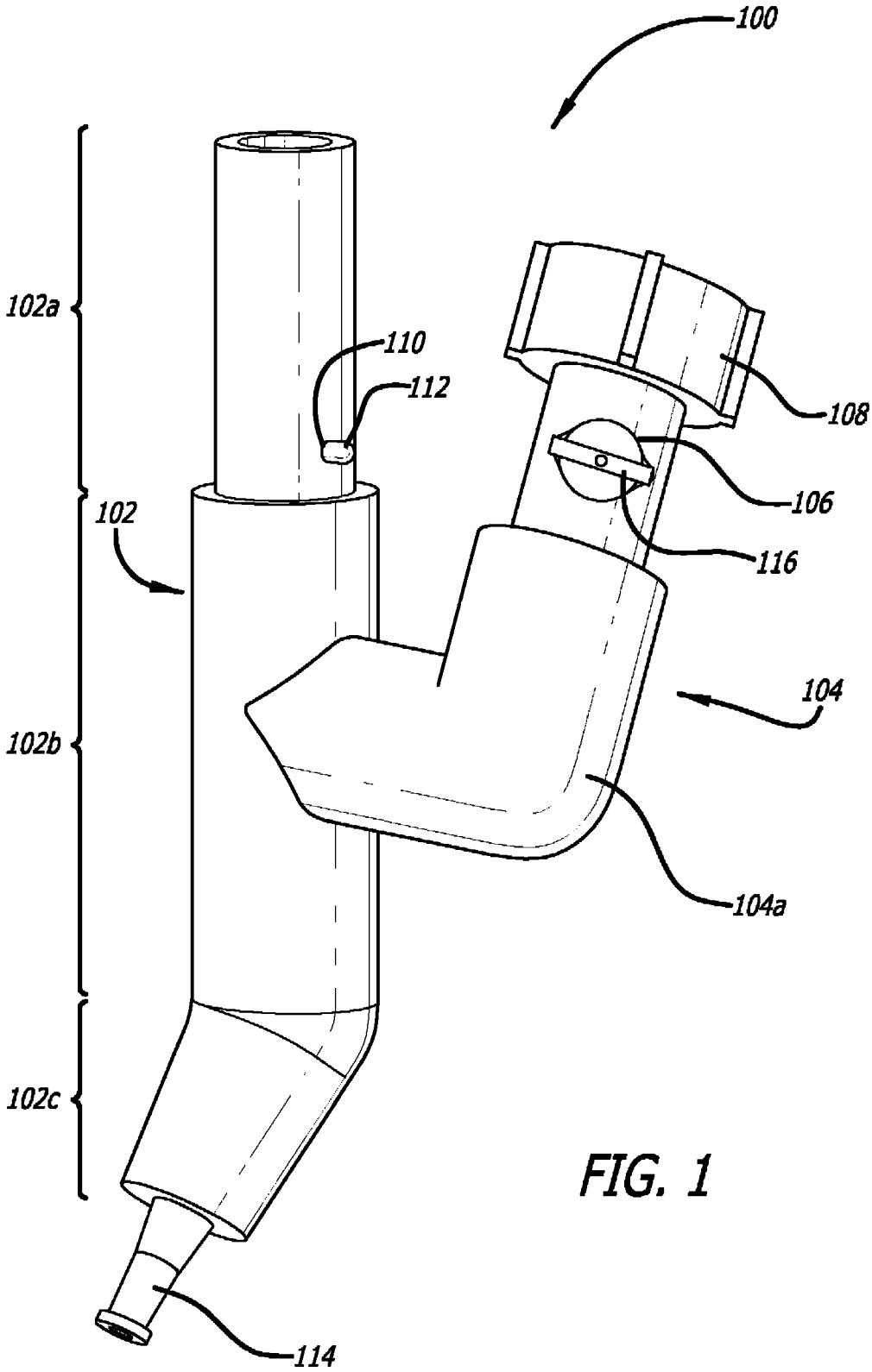
FIG. 1 illustrates a perspective view of a pool cleaning device according to embodiments of the invention.

FIG. 1 illustrates a perspective view of a pool cleaning device according to an embodiment of the invention. As shown, the pool cleaning device 100 is generally comprised of a primary component 102 and a secondary component 104 in fluid communication with one another. From a proximal end to a distal end, the primary component 102 may have a tubular configuration and may terminate in an angled configuration therewith. The secondary component may have an angled tubular configuration and may be in fluid communication with one or more specialized units, such as a ball valve shut-off component 106 having a hose connection member 108. In one embodiment, the secondary component 104 is angled between about 15° and 30° relative to the primary component 102.

In one embodiment, a proximal portion 102*a* of the primary component 102 has a diameter less than a diameter of a medial portion 102*b* of the primary component 102. Also, proximal portion 102*a* may include at least two apertures 110 (only one aperture 110 shown) distanced about 180° from one another in order to receive push-buttons 112 (only one button 112 shown) from a push-button locking mechanism positioned therein (not shown). In this manner, the proximal portion 102*a* of the primary component 102 is able to reversibly couple and lock to a telescopic pole (explained in more detail below).

In one embodiment, a distal portion 102*c* of the primary component 102 is angled at about 45° relative to the proximal and medial portions 102*a*, 102*b* of the primary component 102. In this manner, when coupled to a telescopic pole, the pool cleaning device 100 may be directed to the submerged sidewalls of a swimming pool for cleaning thereof. According to embodiments of the invention, the distal portion 102*c* of the primary component 102 terminates in a nozzle 114 such as a threaded nip sweeper nozzle; however, other suitable nozzles as known by one of ordinary skill in the art are within the scope of the invention. Materials comprising the primary component 102 include, but are not limited to, metal, metal alloys or synthetic materials such as polyvinyl chloride (PVC). In some embodiments, the tubular members include an anti-bacterial material to mitigate, control and/or prevent bacterial build-up.

Continuing to refer to FIG. 1, the secondary component 104 may include angled tubular member 104*a* in fluid communication with ball valve shut-off component 106 terminating in hose connection member 108. Generally, the secondary component 104 is angled at about 90° relative to a horizontal plane. The hose connection member 108 may be adapted to receive a standard garden hose nozzle and may be configured as known by one of ordinary skill in the art. In some embodiments, hose connection member 108 has an anti-siphon connection to avoid water being siphoned into the hose when connected thereto.

The ball valve shut-off valve component 106 may have an ON/OFF knob 116 located externally thereto. In the ON position, an internal ball having an opening thereto (not shown) allows water flow-through. In the OFF position, the internal ball blocks the flow of water. The knob 116 may be turned between the ON and OFF position to control the amount of water flowing through the pool cleaning device 100. Similar to the materials comprising the primary component 102, materials comprising the secondary component 104 and the specialized components include, but are not limited to, metal, metal alloys or synthetic materials such as PVC.

Figure 2:
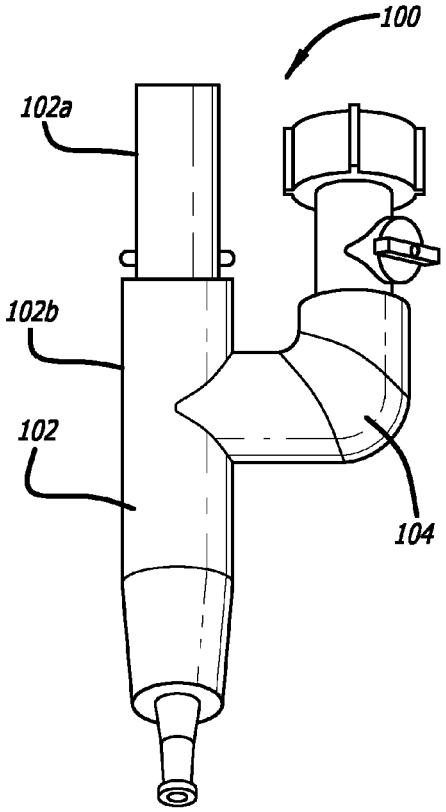
FIG. 2 illustrates a front view of the pooling cleaning device of FIG. 1.

FIG. 2 illustrates a front view of the pooling cleaning device of FIG. 1. In this view, the primary component 102 and the secondary component 104 of the pool cleaning device 100 are shown. In some embodiments, the proximal portion 102*a* of the primary component 102 has a diameter of between about three-fourths (¾) inches and about one (1) inch while the medial portion 102*b* has a diameter of between about one (1) inch and about one and one-fourth (1¼) inches. In this manner, the proximal portion 102*a* of the primary component 102 is able to reversibly couple and lock to a telescopic pole so that the pool cleaning device 100 can be manipulated by the user to clean submerged surfaces or water surface debris of a swimming pool.

Figure 3:
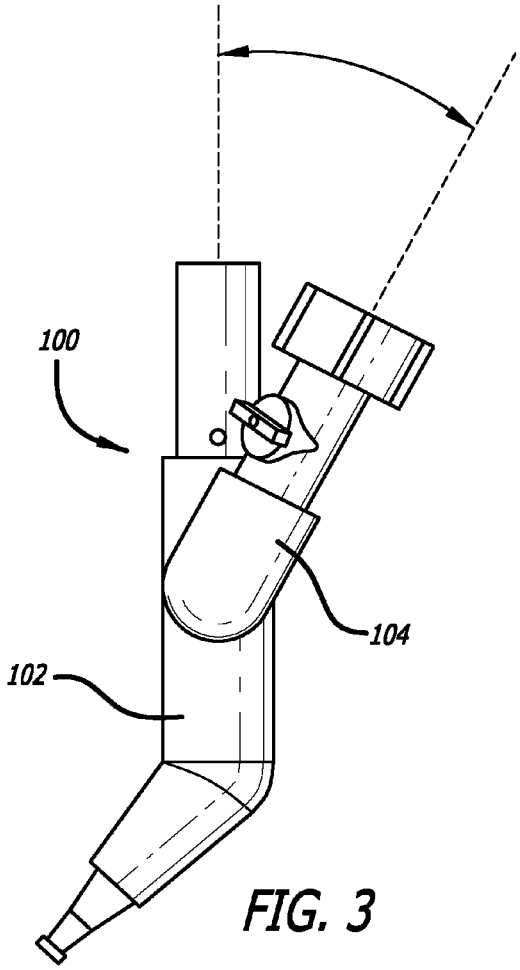
FIG. 3 illustrates a side view of the pooling cleaning device of FIG. 1.

FIG. 3 illustrates a side view of the pooling cleaning device of FIG. 1. In this view, the angled nature of the secondary component 104 relative to the primary component 102 when the primary component 102 is in a vertically-oriented position is more clearly illustrated. This configuration confers numerous advantages over conventional pool cleaning devices which are explained in more detail below.

Figure 4:
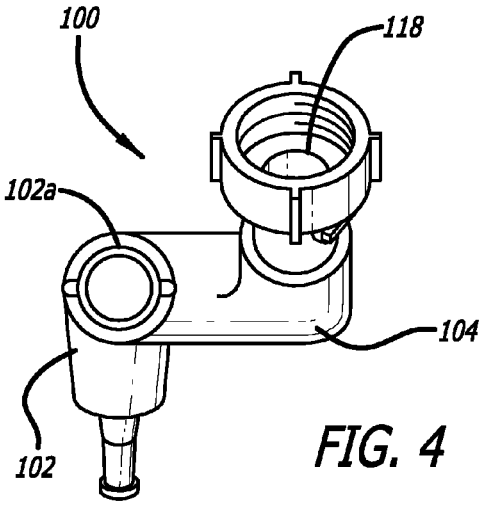
FIG. 4 illustrates a top view of the pooling cleaning device of FIG. 1.

FIG. 4 illustrates a top view of the pooling cleaning device of FIG. 1. In this view, the angled nature of the secondary component 104 relative to the primary component 102 when the primary component 102 is in a vertically-oriented position is more clearly illustrated. The proximal portion 102*a* of the primary component 102 may be adapted to couple to a telescopic pole (not shown, see FIG. 5) while an opening 120 of the secondary component may simultaneously be adapted to couple to a hose (not shown, see FIG. 5).

Figure 5:
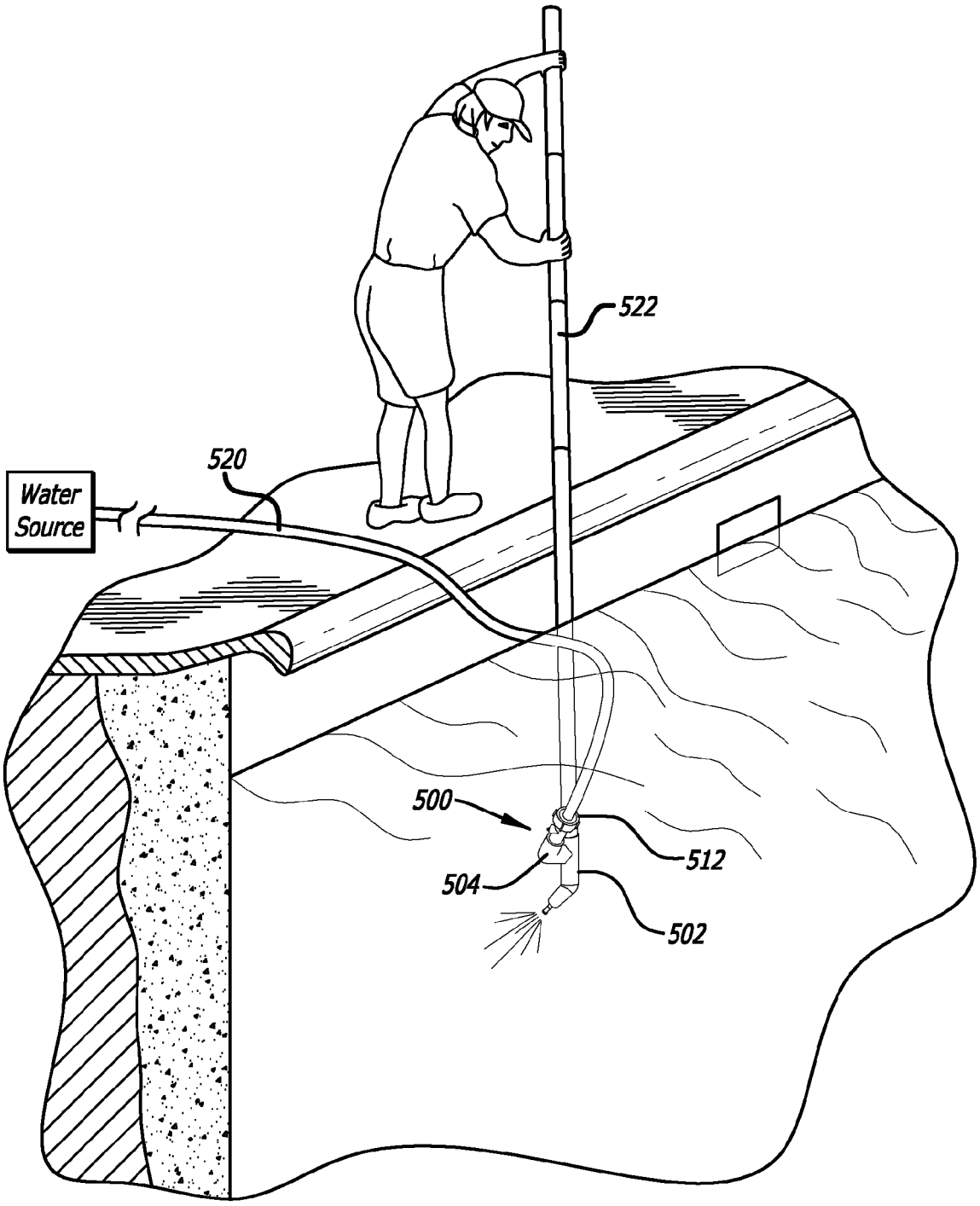
FIG. 5 illustrates a pool cleaning device according to embodiments of the invention coupled to a telescopic pole and a hose and being used by a user to clean submerged surfaces of a pool.

FIG. 5 illustrates a pool cleaning device according to an embodiment of the invention coupled to a telescopic pole and a hose being and used by a user. In this view, a hose 520 is coupled to a hose connection member 512 of a secondary component 504 of a pool cleaning device 500 while a telescopic pole 522 is simultaneously coupled to a primary component 502 of the pool cleaning device 500. According to embodiments of the invention, the secondary component 504 is angled between about 15° and 30° relative to the primary component 502.

The angled configuration as previously described confers numerous advantages over conventional pool cleaning devices. For example, when a hose is connected to the hose connection member and the device is in use, the angled configuration of the second assembly substantially or completely prevents kinking of the hose which restricts water flow. If the hose is kinked, there is not sufficient pressure to effectuate a spray jet to effectively clean, for example, algae and other material build-up on the submerged surfaces of the swimming pool. Additionally, taking into consideration the sloped inner surfaces of a pool, the angled configuration of the device according to embodiments of the invention helps to direct spray in the direction of the slope without the user having to hold the pole at an awkward angle. Additionally, when cleaning the surface water, the device according to embodiments of the invention directs water spray along the surface without the user being forced to hold the telescopic pole at knee-level. As the water gets deeper (shallow to deep end), the device moves surface debris to the deep end for easy retrieval.

While certain exemplary embodiments have been described and shown in the accompanying drawings, it is to be understood that such embodiments are merely illustrative of and not restrictive on the broad invention, and that this invention is not to be limited to the specific constructions and arrangements shown and described, since various other modifications may occur to those ordinarily skilled in the art.

What is claimed is:

1. A pool cleaning device, comprising:

a primary component adapted to receive a handle, the primary component comprising:

a proximal portion, a medial portion and a distal portion, the primary component allowing a high pressure fluid to flow therethrough, the medial portion integrally connected between the proximal portion and the distal portion; and the proximal portion and the medial portion being coaxial about a first longitudinal axis, with the distal portion extending in a generally distal direction towards a distal end of the device and having a second longitudinal axis at a first angle of 45° relative to the first longitudinal axis, the first angle being an included angle when measured from the distal end of the device;

a secondary component in fluid communication with the primary component, the secondary component comprising a first tubular member with a proximal inlet end adapted to receive a supply of high pressure fluid and a second tubular member with a first end attached to, and extending perpendicularly outward from, the medial portion of the primary component allowing the high pressure fluid to flow therethrough, wherein the first tubular member extends from a second end of the second tubular member in a generally proximal direction away from the distal end of the device and having a third longitudinal axis at a second angle between 15° and 30° relative to the medial portion of the primary component, the second angle being an included angle when measured from a proximal end of the device, and the second angle being in an inlet direction substantially opposite to an outlet direction;

a nozzle for discharging high pressure fluid in the outlet direction, the nozzle extending outward from the distal portion of the primary component, and the nozzle and the distal portion of the primary component being about coaxial about the second longitudinal axis; and a ball valve shut-off component in fluid communication with the first tubular member of the secondary component, a proximal end of the ball shut-off valve component terminating in a hose connection component.

2. The pool cleaning device of claim 1 wherein the proximal portion of the primary component has a diameter less than a diameter of the medial portion of the primary component.

3. The pool cleaning device of claim 1 wherein the proximal portion of the primary component has at least two apertures distanced 180° from one another.

4. The pool cleaning device of claim 3 wherein the at least two apertures are adapted to receive buttons from a push-button locking mechanism positioned within the proximal portion of the primary component.

5. The pool cleaning device of claim 3 wherein the primary component is adapted to couple to a telescopic pole.

6. The pool cleaning device of claim 4 wherein a hose connection member is adapted to couple to a hose nozzle.

7. The pool cleaning device of claim 1 wherein the ball valve shut-off component includes an ON/OFF knob on an outer surface thereof.

8. The pool cleaning device of claim 1 wherein the high pressure fluid flows from the secondary component to the medial and distal portions of the primary component.

9. The pool cleaning device of claim 8 wherein the proximal portion of the primary component has an outer diameter less than an inner diameter of the telescopic pole.

10. The pool cleaning device of claim 8 wherein the proximal portion of the primary component has at least two apertures distanced 180° from one another.

11. The pool cleaning device of claim 10 wherein the at least two apertures are adapted to receive buttons from a push-button locking mechanism positioned within the proximal portion of the primary component.

12. The pool cleaning device of claim 8 wherein a hose connection member is adapted to couple to a hose nozzle.

13. The pool cleaning device of claim 8 wherein the ball valve shut-off component includes an ON/OFF knob on an outer surface thereof.

14. A pool cleaning device, comprising:

a primary component adapted to receive a handle and comprising a proximal portion, a medial portion and a distal portion, the primary component allowing a high pressure fluid to flow therethrough, the proximal portion and the medial portion being coaxial about a first longitudinal axis with the distal portion extending in a generally distal direction towards a distal end of the device and having a second longitudinal axis at a first angle of 45° relative to the first longitudinal axis, the first angle being an included angle when measured from the distal end of the device;

a secondary component in fluid communication with the primary component, the secondary component comprising a first tubular member with a proximal inlet end adapted to receive a supply of high pressure fluid and a second tubular member with a first end attached to, and extending perpendicularly outward from, the medial portion of the primary component allowing the high pressure fluid to flow therethrough, wherein the first tubular member extends from a second end of the second tubular member in a generally proximal direction away from the distal end of the device and having a third longitudinal axis at a second angle between 15° and 30° relative to the medial portion of the primary component, the second angle being an included angle when measured from a proximal end of the device, and the second angle being in an inlet direction substantially opposite to an outlet direction; and a nozzle, in fluid communication with the distal portion of the primary component, configured to discharge the high pressure fluid;

wherein the nozzle is an elongated tubular shaped member; and wherein a diameter of the nozzle is smaller than a diameter of the distal portion of the primary component.

15. The pool cleaning device of claim 14 wherein the proximal portion of the primary component has a diameter less than a diameter of the medial portion of the primary component.

16. The pool cleaning device of claim 15 wherein the proximal portion of the primary component has at least two apertures distanced 180° from one another.

17. A pool cleaning device, comprising:

a primary component adapted to receive a handle and allow a high pressure fluid to flow therethrough, the primary component comprising:

a proximal portion having a first proximal end and a second proximal end;

a distal portion having a first distal end and a second distal end; and a medial portion having a first medial end and a second medial end, the medial portion integrally connected between, and in fluid communication with, the proximal portion and the distal portion, where the first medial end is integrally connected to the second proximal end and the second medial end is integrally connected to the first distal end;

where the proximal portion and the medial portion being coaxial about a first longitudinal axis, with the distal portion extending in a generally distal direction towards a distal end of the device and having a second longitudinal axis at a first angle of 45° relative to the first longitudinal axis, the first angle being an included angle when measured from the distal end of the device; and a secondary component in fluid communication with the primary component, the secondary component comprising:

a first tubular member with a proximal inlet end adapted to receive a supply of high pressure fluid; and a second tubular member with a first end attached to, and extending perpendicularly outward from, the medial portion of the primary component allowing the high pressure fluid to flow therethrough, wherein the first tubular member extends from a second end of the second tubular member in a generally proximal direction away from the distal end of the device and having a third longitudinal axis at a second angle between 15° and 30° relative to the medial portion of the primary component, the second angle being an included angle when measured from a proximal end of the device, and the second angle being in an inlet direction substantially opposite to an outlet direction; and a nozzle for discharging high pressure fluid in the outlet direction, the nozzle extending outward from the distal portion of the primary component, and the nozzle and the distal portion of the primary component being about coaxial about the second longitudinal axis.

18. The pool cleaning device of claim 17, wherein a diameter of the nozzle is smaller than a diameter of the distal portion of the primary component.

* * * * *